US011898363B2

(12) United States Patent
Williamson

(10) Patent No.: US 11,898,363 B2
(45) Date of Patent: Feb. 13, 2024

(54) PORTABLE TELESCOPIC THREADED UTILITY POLE

(71) Applicant: James G. Williamson, New Wilmington, PA (US)

(72) Inventor: James G. Williamson, New Wilmington, PA (US)

( * ) Notice: Subject to any disclaimer, the term of this patent is extended or adjusted under 35 U.S.C. 154(b) by 0 days.

(21) Appl. No.: 17/724,607

(22) Filed: Apr. 20, 2022

(65) Prior Publication Data

US 2022/0243489 A1 Aug. 4, 2022

Related U.S. Application Data

(63) Continuation of application No. 17/073,442, filed on Oct. 19, 2020, now Pat. No. 11,332,953.

(60) Provisional application No. 62/916,916, filed on Oct. 18, 2019.

(51) Int. Cl.
*E04H 12/18* (2006.01)

(52) U.S. Cl.
CPC ..... *E04H 12/18* (2013.01)

(58) Field of Classification Search
CPC ..... E04H 12/18; E04H 12/182
See application file for complete search history.

(56) References Cited

U.S. PATENT DOCUMENTS 3,270,480 A 9/1966 William
4,651,581 A 3/1987 Svensson
5,035,094 A * 7/1991 Legare ..... F16H 25/2056 343/903
5,333,436 A 8/1994 Noble
5,398,478 A 3/1995 Gordin et al.
5,600,537 A 2/1997 Gordin et al.
6,191,355 B1 2/2001 Edelstein
6,340,790 B1 1/2002 Gordin et al.
6,398,392 B2 6/2002 Gordin et al.
6,399,881 B2 6/2002 Edelstein
6,761,387 B2 * 7/2004 Sloss ..... B60P 3/40 296/26.05
7,171,793 B2 2/2007 Gordin et al.
7,358,911 B2 * 4/2008 Vincent ..... H01Q 1/36 343/722
7,497,140 B2 3/2009 Blackwelder et al.
7,726,920 B2 * 6/2010 Bullock ..... B60P 7/135 410/118
8,302,368 B1 11/2012 Keel
8,413,390 B2 4/2013 Pereira
8,422,716 B2 * 4/2013 Wetzel ..... F16B 7/14 403/109.5
8,887,450 B2 * 11/2014 Blackwelder ..... F16C 19/54 52/118
10,294,687 B2 5/2019 Brockman et al.
10,385,603 B2 8/2019 Fletcher
11,332,953 B2 * 5/2022 Williamson ..... E04H 12/18
2003/0089073 A1 5/2003 Enns
(Continued)

*Primary Examiner* — Andrew J Triggs
(74) *Attorney, Agent, or Firm* — Kathleen Koznicki; The Lynch Law Group, LLC

(57) ABSTRACT

Disclosed is a telescopic utility pole where the individual segments are threaded on the outer and inner surfaces, the adjacent segments are threadedly engaged and extension/retraction of the pole segments is performed by twisting along threaded path. The advantage of using the threaded telescopic utility pole is that it can be deployed and erected quickly as compared to traditional utility poles.

19 Claims, 8 Drawing Sheets

(56) References Cited

U.S. PATENT DOCUMENTS

| | | | | |
|---|---|---|---|---|
| 2004/0139665 | A1 | 7/2004 | Ullrich | |
| 2009/0019816 | A1 | 1/2009 | Lockwood | |
| 2011/0047900 | A1 | 3/2011 | Holmes | |
| 2022/0243489 | A1* | 8/2022 | Williamson | ..... E04H 12/182 |

* cited by examiner

PORTABLE TELESCOPIC THREADED UTILITY POLE

This non-provisional application is a continuation of U.S. non-provisional application Ser. No. 17/073,442 filed on Oct. 19, 2020, which in turn claims priority to U.S. provisional application Ser. No. 62/916,916 entitled Portable Telescopic Threaded Utility Pole filed on Oct. 18, 2019. All of the content of non-provisional application Ser. No. 17/073,442 and provisional application 62/916,916 is fully incorporated into this non-provisional application.

Field of the Invention: The claimed invention is for a telescopic utility pole that uses threaded segments as the means for extending or retracting said pole.

BACKGROUND

Disasters such as earthquakes, hurricanes, or tornadoes can knock down utility poles leaving large areas without power and other utilities. This is especially troubling for hospitals or other facilities vital to the local area. Rebuilding of the local power grid using traditional utility poles takes a significant amount of time. Installation of traditional utility poles require holes that must be dug out by large motorized construction equipment. This motorized equipment must be transported into these disaster areas which might not be feasible or timely depending on the nature of the disaster. Having a way to quickly reestablish the power grid so that at least the most critical facilities are up running soon could be the difference between life and death for residents in disaster areas. Also, if there is extensive damage to residential areas, reestablishing power quickly to homes can be start for residents to begin clean-up.

Telescopic utility poles are known and have been used for installation of functional equipment (U.S. Pat. Nos. 3,270,480; 5,333,436; 5,398,478; 5,600,537; 6,191,355; 6,340,790; 6,398,392; 6,399,881; 71,717,793; 7,497,140; 8,302,368; 8,413,390; 8,887,450; U.S. Ser. No. 10/294,687; US 20030089073; US 20040139665; US 20090019816; US20110047900). However, these designs have considerable disadvantages for quick installation in a disaster area. Many of the previous pole use tapered segments, this increases the complexity of manufacturing which increases the time and cost of such poles. Other poles require the use of motorized, hydraulic, or pneumatic systems to extend the poles. Other telescopic pole designs use complex connections/joints/assemblies with numerous loose parts (bolt/nuts, etc.) which make assembly of the segments time consuming, as well as having the burden to transport all the necessary parts. Some of the previous telescopic poles need to be attached to a vehicle for stability, while others have complex bottom attachments for stability.

What is needed is a simplified, compact, easily transportable telescopic utility pole. Optionally, and ideally, the telescopic utility pole can be extended and/or erected manually, (i.e. by NOT by using a motorized/hydraulic/pneumatic system).

SUMMARY OF THE INVENTION

Disclosed is a telescopic utility pole where the individual segments are threaded on the outer and inner surfaces, the adjacent segments are threadedly engaged and extension/retraction of the pole segments is performed by twisting along threaded path (a typical screw in/screw out method). Preferably, the extension/retraction is done manually or by workers using only battery power tools. However, the disclosure also contemplates embodiments that utilize motorized/hydraulic/pneumatic systems for extension/retraction. The threaded telescopic utility poles can be transported to an area in need (disaster or not) while in the compact configuration in conjunction with a chassis that is equipped for the necessary conditions of the local area where the poles are needed. The number and arrangement of the poles will depend on the local conditions.

SHORT DESCRIPTION OF FIGURES

FIG. 1A discloses an embodiment of the pole in a compact configuration. (fully threaded with collets)

FIG. 1B discloses an embodiment of the pole in FIG. 1A in a fully erected configuration.

DESCRIPTION

Figure 1A:
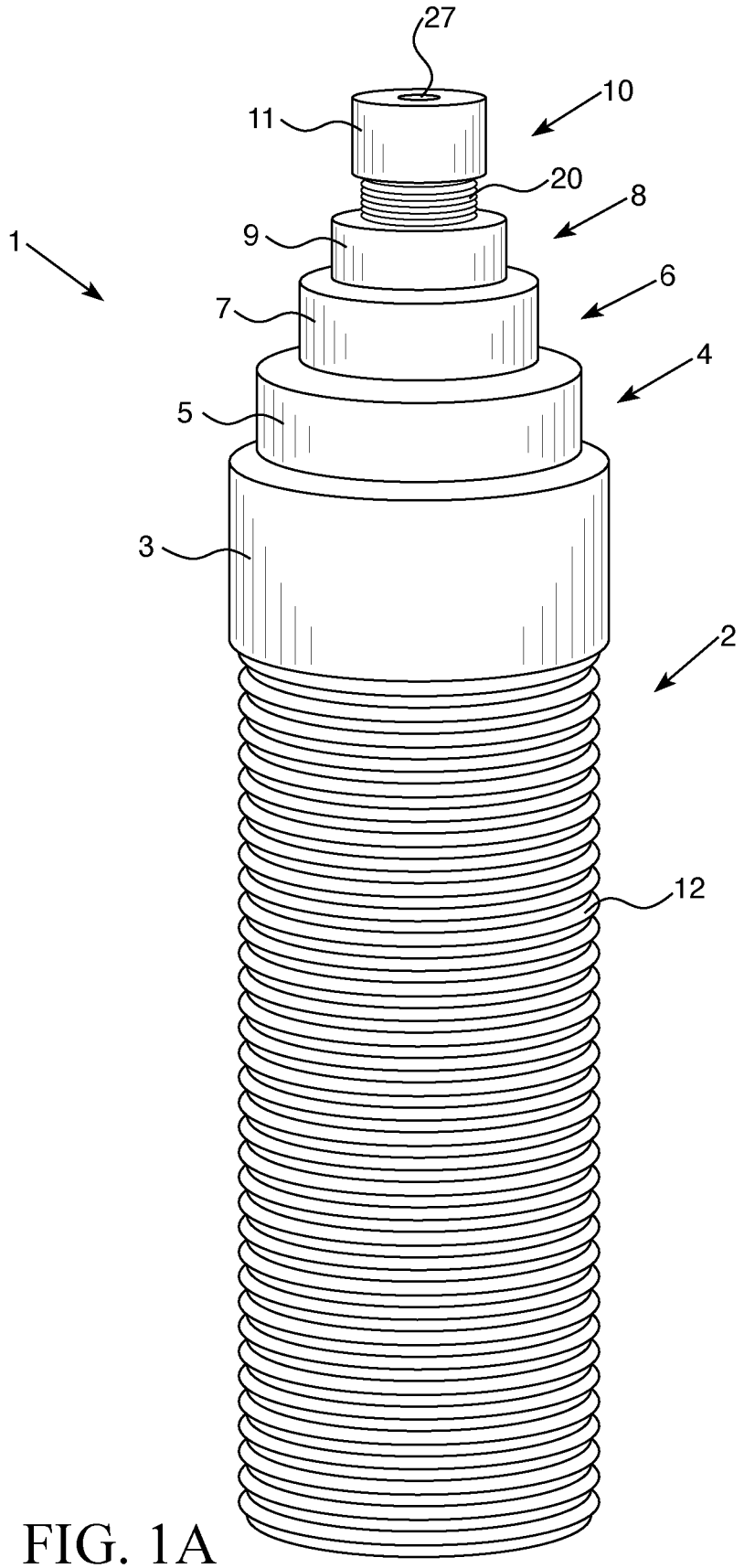

A typical/traditional utility pole is 40 ft in height and buried 6 ft into the ground for stability. Depending the actual clearance requirements of a specific area, it is not uncommon for utility poles to be 120 ft or even 200 ft in length. The spacing between the poles is typically 125 ft apart for urban areas and 300-400 ft apart for rural areas. Actual specifications that depend on the local area/terrain/environment can be found in the National Electric Safety Code (NESC), a guidance provided by the Institute of Electrical and Electronics Engineers Standards Association (IEEE-SA). Disclosed is a telescopic utility pole whereby the segments are threadedly engaged to allow for ease of extension or retraction, said pole comprising a plurality of hollow cylindrical segments assembled telescopically. Retraction in the compact configuration is for ease of transport and the height of extension in a full or partial erection configuration will ultimately depend on the need of the user. Typically to work in most scenarios, the individual segments will be approximately 9.5 ft in length including the collet and the threaded outer surface, with an individual's erection height within the assembled telescopic pole being approximately 8 ft. When five telescopic segments are used, the total threaded telescopic pole length at full erection will be approximately 40 ft, with the option to only be partially erected in cases where that is necessary. However, this disclosure contemplates any number of segments that are of any length and a total length of a pole that can satisfy the actual specification requirements that are need as described above in the specific local area in which the threaded telescopic utility poles are being used. As these are telescopic segments, the width decreases from the outermost segment to the innermost segment. As non-limiting example, the outermost segment can be 30 inches, the adjacent inner segment can be 24 inches, the next inner segment can be 18 inches, the next inner after that can be 12 inches and the innermost segment can be 9 inches. However, any width ranges that allow the formation of a functional telescopic pole is contemplated by this disclosure. An advantage to using threaded segments is the that the segments are not tapered and are easier to erected or retract. The threaded telescopic poles shown in the Figures are for illustration purposes only and are not meant to be limiting. The ultimate function of utility pole can be to provide electrical wire/service, telephonic wire/service, cable TV wire/service, light fixtures, transformers, etc. Any typical function of a utility pole is contemplated by this disclosure. The claimed invention can also be used as flagpole if circumstances permit.

Figure 1B:
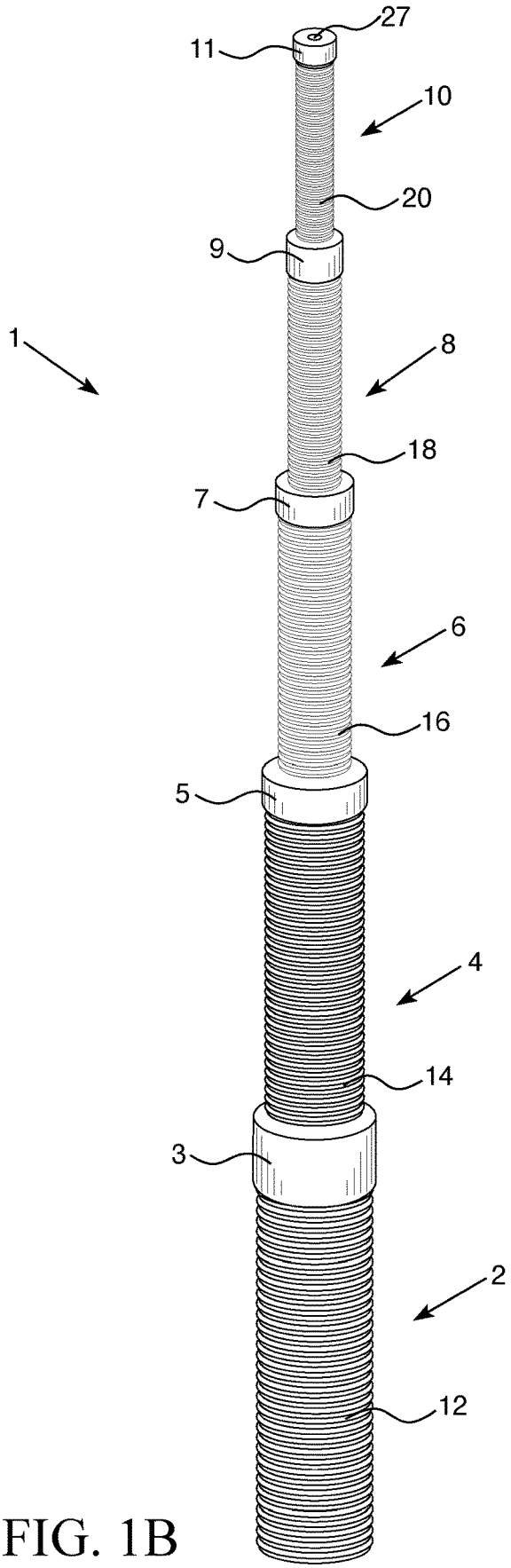
Figure 2A:
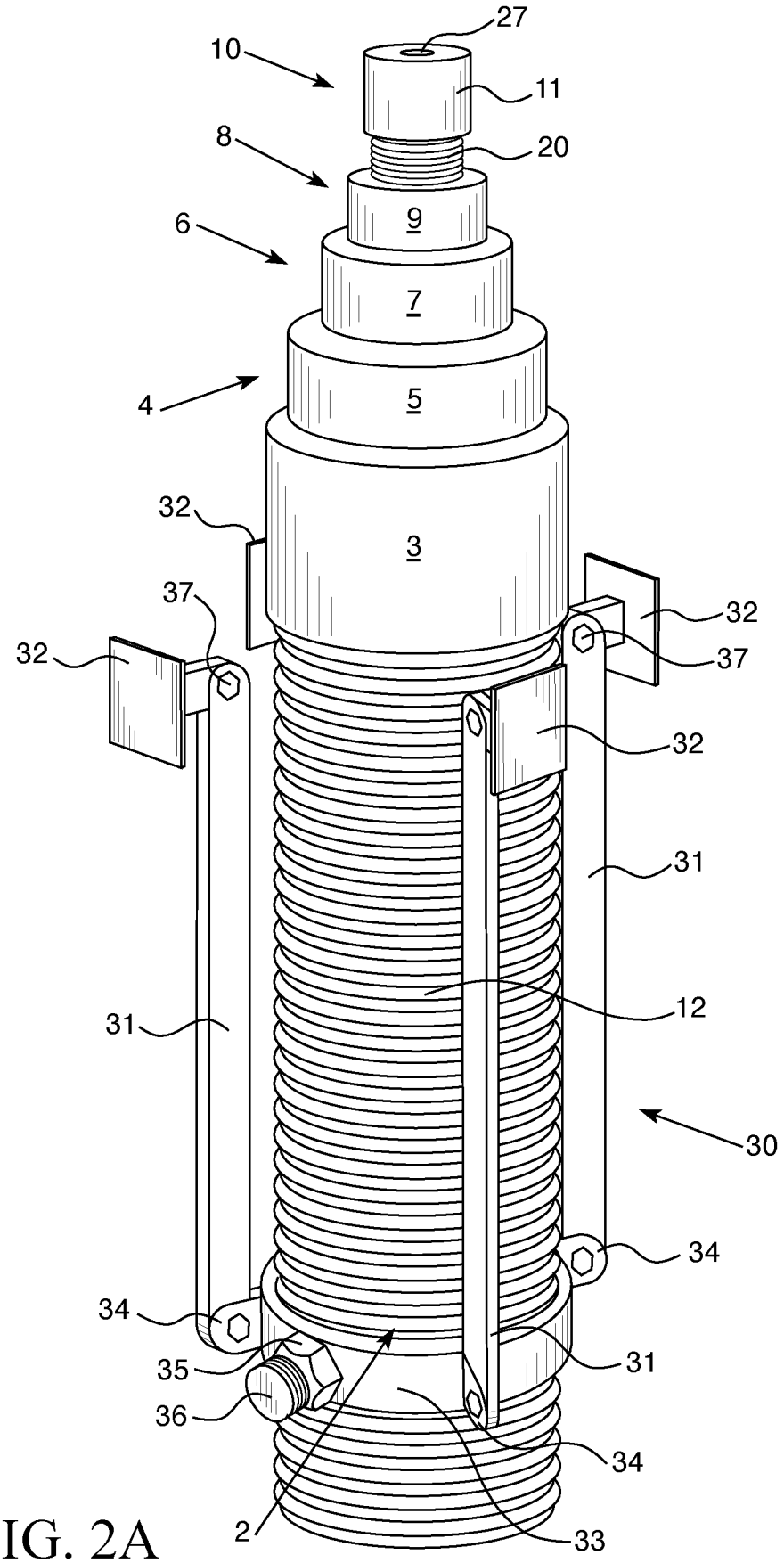
FIG. 2A shows an embodiment of the pole in a compact configuration with an all-terrain base stabilizer in a folded position.
Figure 2B:
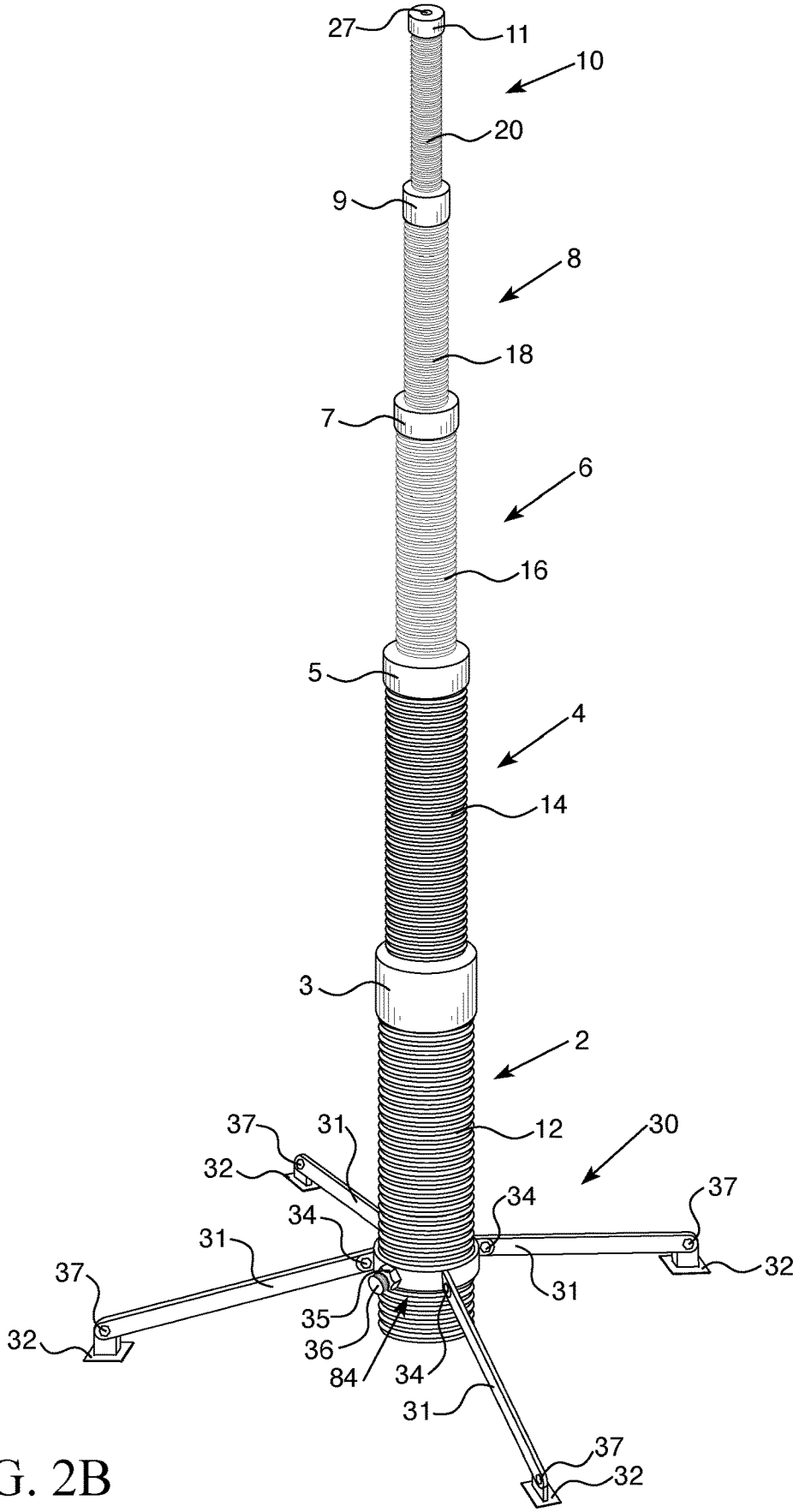
FIG. 2B shows an embodiment of the pole in a fully erect configuration with an all-terrain base stabilizer in an extended position.
Figure 2C:
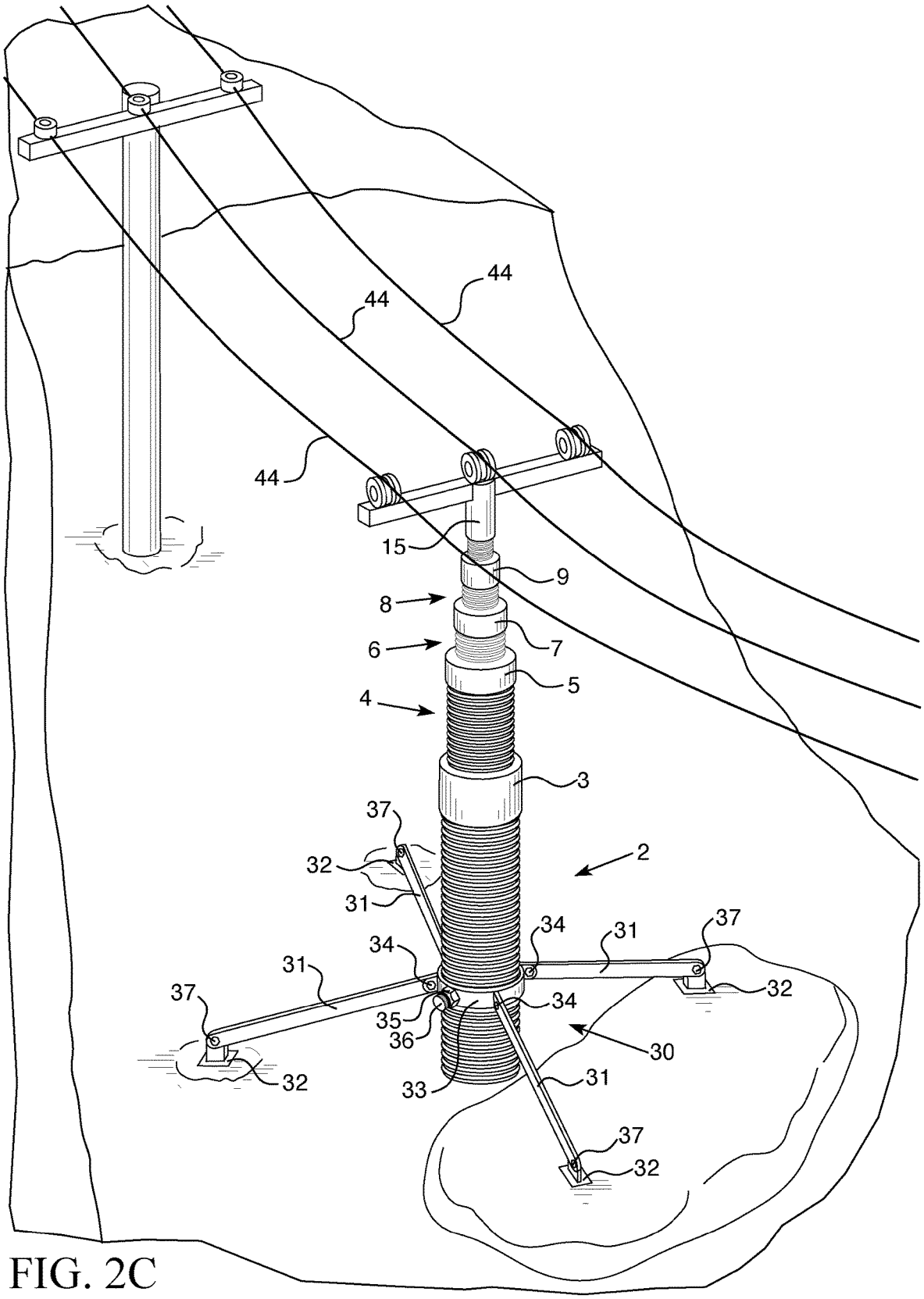
FIG. 2C shows a close-up view of an embodiment of the pole with an all-terrain stabilizer on a rocky terrain in a partial erection configuration utilizing a wire attachment.
Figure 3:
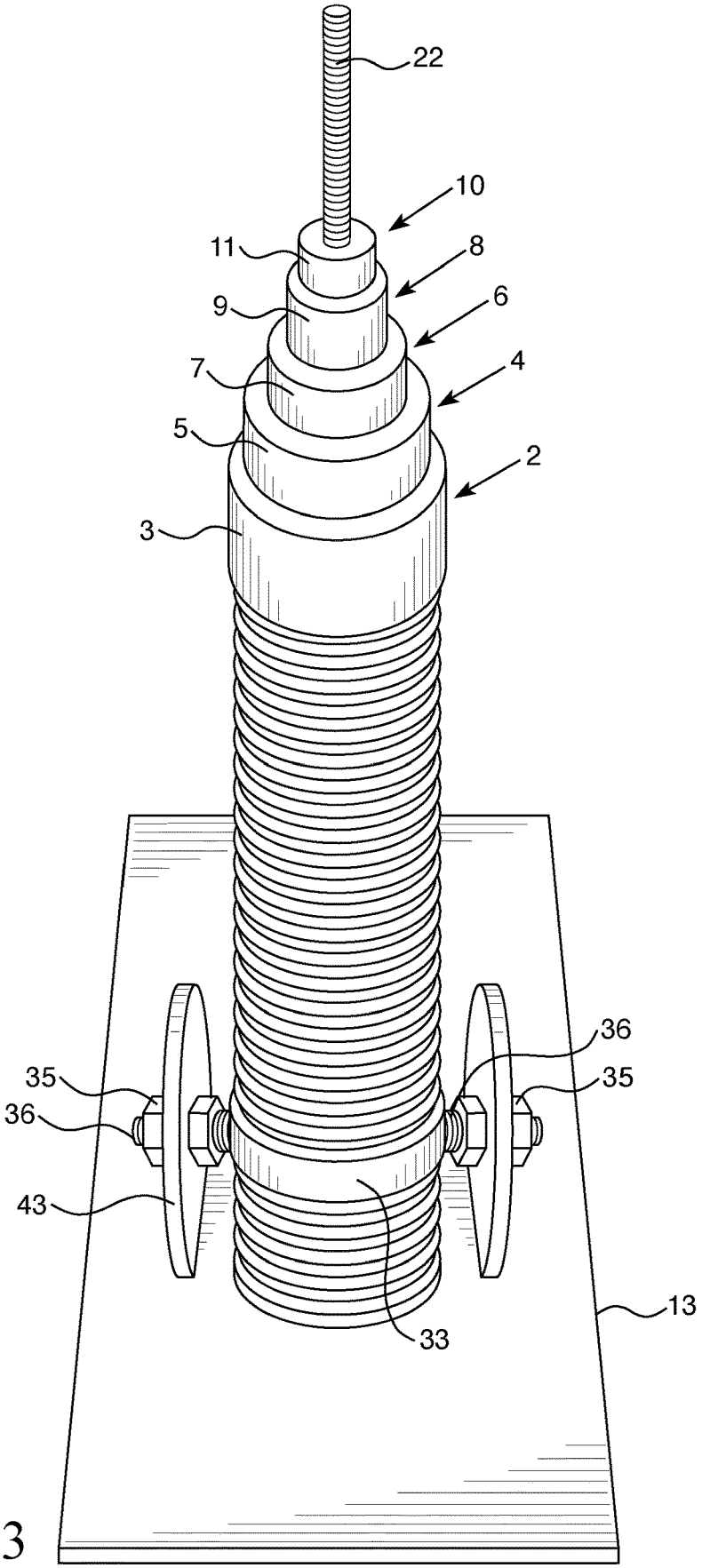
FIG. 3 shows an embodiment of the pole on a chassis in the pre erection configuration using a rod in conjunction with the chassis for stabilization.

The claimed invention is a utility pole comprising a plurality of hollow cylindrical segments assembled telescopically. The pole is capable of being in a compact configuration when being used for transport and is capable of being in an erected configuration for receiving functional equipment and/or attachments for functional equipment. A scaled model is being used to represent an embodiment of the invention in FIGS. 1-3. FIGS. 1-3 show various positions of the same pole being used to illustrate the claimed invention; the numerals refer to the same parts in all the FIGS. 1-3.

Pole 1 is comprised of telescopically and threadedly engaged segments (2, 4, 6, 8, 10). 2 is the outermost segment with the largest diameter and 10 is the innermost segment having the smallest diameter with an exposed opening 27; 4, 6, and 8 are middle segments. On the top of each segment (while in the vertical position) is a collet (3, 5, 7, 9, 11). The collets can either be permanent or the collets can be removable. The collets can be in any style including a chamfer collet. The exterior of the collets is smooth, the interior of the collets is threaded. The thickness of the collets of the various inner segments is are wider than the hole of the immediately adjacent outer segment, this prevents the various segments from retracting too far into its outer telescopically engaged segment. Some embodiments may not use collets at all. The inner surfaces (not shown) and outer surfaces of the segments (12, 14, 16, 18, 20) are threaded, and the individual segments are threadedly engaged to their outer adjacent segment (except the outermost segment) and to their inner adjacent segment (except the innermost segment). To extend the pole the various segments are twisted along their threaded paths, until all the segments are fully erected out from their adjacent outer segment. Optionally, half-moon bubble rivets (not shown) are pressed into the segments; these can be used to prevent over erection. When two rivets touch, the threading motion is stopped. Alignment marks can be used for workers to visualize a stable fully erected configuration for each segment with its adjacent outer and inner segments.

Though shown here as threaded, the outer surface of the outermost segment, need not be threaded but could be flat/smooth. The outermost segment can be used to connect the compact pole to a chassis for transport by any means known in the art. Optionally, the inner surface of the innermost segment may not be threaded and alternative means of connecting equipment attachments may be used. And though the innermost segment shown here as having a typical collet at its top, the top can comprise any style or feature that can be used to attach functional equipment or that can act a receptacle for attachments that are used to place the functional equipment.

There are several options for stabilizing the threaded telescopic utility pole. The bottom of the outermost segment can have stabilizing base that integral or that is separately attached. Any feasible design known to those skilled in the art is contemplated by this disclosure. One alternative is shown in FIGS. 2A and 2B. Pole 1 can be deployed with an all-terrain stabilizer 30. Stabilizer 30 is comprised of legs 31, each leg 31 being attached to a foot 32 by a swivel attachment 37. Each leg 31 emanates from hinged attachments 34 connected to base mounting ring 33. Though shown with four legs in this embodiment, any feasible plurality of legs that can stabilize the pole is contemplated by this disclosure. Ring 33 can be attached to segment 2 via the outer surface 12. Preferably ring 33 has a threaded inner surface that mates with the outer surface 12 to attach ring 33 to segment 2 at varying height. In this embodiment the ring 33 has an additional nut 35 and bolt 36 system that allows pole 1 to be attached to various other stabilization devices, any means of attachment known in the art are contemplated by this disclosure. From the hinged attachments 34, legs 31 can pivot to a folded position when the pole 1 is in the compact configuration and legs 31 can pivot to an extended position when pole 1 is deployed in the erected configuration. FIG. 2C shows use of the claimed invention with the all-terrain stabilizer 30 on a rocky terrain in a partial erection configuration simulating the pole 1 replacing a traditional interior pole when said pole is downed for any reason. In this non-limiting example, pole 1 has wire attachment 15 on top of segment 10 attached via collet 11 (both under 15 and not visible in this figure) holding wires 44 in conjunction with the remaining traditional poles. The all-terrain base stabilizer can be used by itself or used in conjunction with the rod stabilization configuration shown.

FIG. 3 shows pole 1 with chassis 13 in the pre erection configuration. In the non-limiting embodiment shown here, pole 1 is attached to the chassis 13 via a base mounting ring 33. Bolt 36 secured by nut 35 is inserted into rotation disks 43 which are used to turn pole 1 from a horizontal traveling configuration to the vertical pre-erection configuration. In this particular embodiment, the innermost segment 10 of pole 1 can be capable of receiving a threaded rod 22 which will continue through the pole 1 when compacted, preferably through a base plate (not shown) located under the pole 1. Any feasible base plate design is contemplated by this disclosure. Preferably the rod 22 length is greater than the length of the pole 1 while in the compact position. Preferably when the pole 1 is used on a soft surface such as the ground, the rod 22 is capable of being inserted into the terrain by an earth penetrating apparatus at the end intended for the ground. If the pole 1 is being used on a hard surface such as a concrete or asphalt surface, the rod 22 can provide another point of force stabilization of the pole to the hard surface using for example, a non-penetrating ball swivel contact Preferably, the when the rod 22 is used for stabilization, the pole 1 will be used in conjunction with chassis 13.

There are numerous chassis that could be used with the threaded telescopic pole of the claimed invention, some basic chassis requirements include: a means to reversibly attach to the outer segment of the pole, a means to transport pole preferably in compacted horizontal position, a means to allow the pole to become vertical and set down to the ground surface, a means to stabilize the pole if the chassis needs to stay connected to pole while in use (temporary pole) or a means to detach from the pole if the pole is in a more permanent situation. The specific attributes of chassis will depend on the terrain of the area in which pole is meant to be used. As non-limiting examples: wheels for hard surfaces or all terrain type wheels for ground, continuous track systems like that used for tanks, skis for snow, pontoon for water, balloon tires for sand, or even for use with a helicopter drop. Depending on functional needs of the local area, the chassis may be equipped with outriggers, pulleys, winches, guy attachment points, wire reels, light fixtures, solar panels, and the equipment that will lifted onto and attached to the pole, such as but not limited to the transformers, electrical wire, cables, telephonic wires, radar, guy rope, and signals, and any attachment pieces thereof.

Figure 4A:
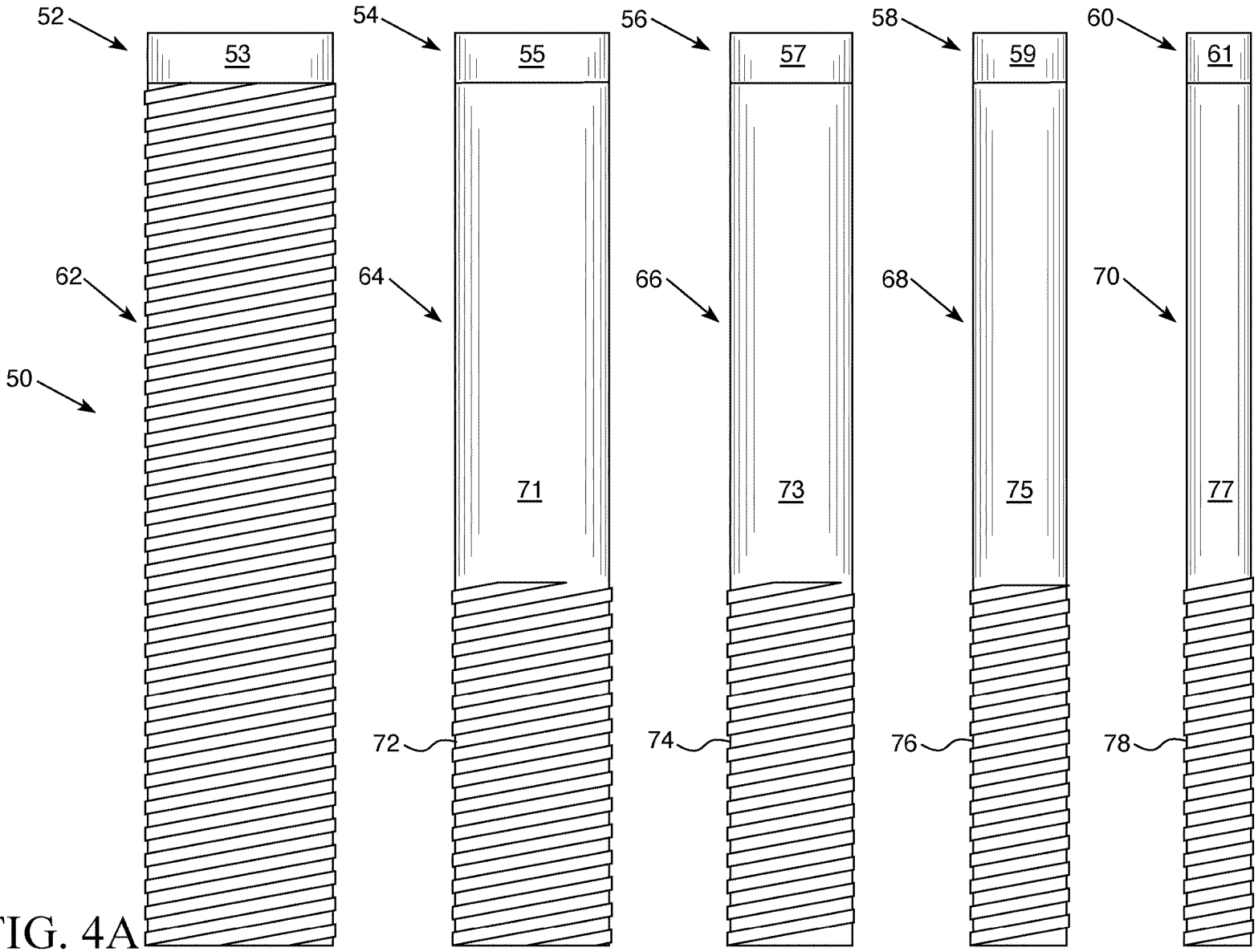
FIG. 4A shows an exploded view of alternative embodiment of the individual segments of pole.
Figure 4B:
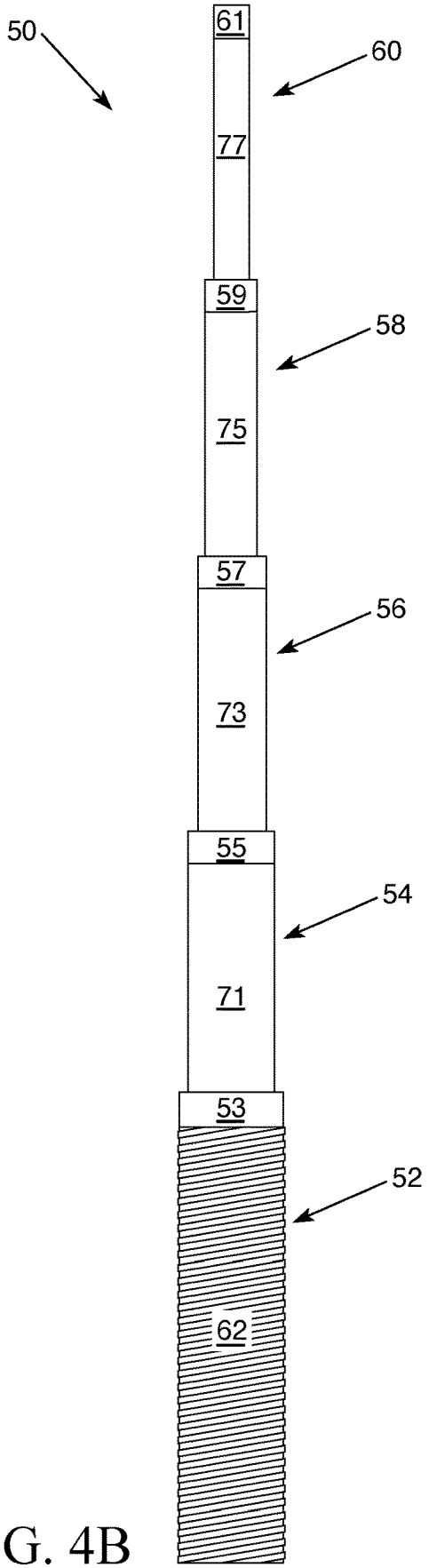
FIG. 4B shows alternative embodiment of the pole in FIG. 4A assembled in the elongated position.

FIG. 4A shows an exploded view of the individual segments of pole 50, whereas FIG. 4B shows the threadedly engaged pole in the elongated position. Pole 50 is comprised of telescopically and threadedly engaged segments (52, 54, 56, 58, 60). 52 is the outermost segment with the largest diameter and 60 is the innermost segment having the smallest diameter with an exposed opening (not shown); 54, 56, and 58 are middle segments. On the top of each segment (while in the vertical position) is a collet (53, 55, 57, 59, 61). The collets can either be permanent or the collets can be removable. The collets can be in any style including a chamfer collet. Some embodiments may not use collets at all. The exterior of the collets is smooth, the interior of the collets is threaded. The thickness of the collets of the various inner segments is are wider than the hole of the immediately adjacent outer segment, this prevents the various segments from retracting too far into its outer telescopically engaged segment. Preferably, the inner surfaces (not shown) are fully threaded and the outer surfaces of the segments (64, 66, 68, 70) are partially threaded, and the individual segments are threadedly engaged to their outer adjacent segment (except the outermost segment) and to their inner adjacent segment (except the innermost segment). 71, 73, 75, and 77 depict the smooth section of the outer surface of the individual segments 64, 66, 68, 70 and 72, 74, 76, and 78 depict the threaded section of the outer surface of the individual segments 64, 66, 68, 70. Each smooth section (71, 73, 75, 77) of the outer surface of the individual segments (64, 66, 68, 70) is less than the height of each of the threaded sections (72, 74, 76, 78) to allow complete retraction or extension of each segment into its adjacent counterpart. The outer surface 62 of the outermost segment 52 is fully threaded to accommodate various means of attachments to various devices used to enable the pole 50 to sand fully erect in the area it is being used. In the assembled, elongated pole as shown in FIG. 4B, the threaded sections of outer surfaces are recessed and not visible when the pole is erected. To extend the pole the various segments are twisted along their threaded paths, until all the segments are fully erected out from their adjacent outer segment. Optionally, half-moon bubble rivets (not shown) are pressed into the segments; these can be used to prevent over erection. When two rivets touch, the threading motion is stopped. Alignment marks can be used for workers to visualize a stable fully erected configuration for each segment with its adjacent outer and inner segments.

Though shown here as fully threaded, the outer surface of the outermost segment, need not be threaded but could be flat/smooth. The outermost segment can be used to connect the compact pole to a chassis for transport by any means known in the art. Optionally, the inner surface of the innermost segment may not be threaded; though threading may be useful as means of connecting equipment attachments or equipment itself. And though the innermost segment shown here as having a typical collet at its top, the top can comprise any style or feature that can be used to attach functional equipment or that can act a receptacle for attachments that are used to place the functional equipment.

The outer surfaces of the segments of the threaded telescopic utility pole is comprised of threading. In certain embodiments, the threading pattern can be a square thread form. In certain embodiments, the square threading may have holes placed to allow for insertion of any accessory equipment. In certain embodiments, in the threading pattern on the segments, one revolution ranges between 4-8 inches in height. However, any feasible threading pattern, any feasible threading pitch, or any threading form known in the field is contemplated by this disclosure.

Optionally the segments can be capable of receiving peg or pins. The pegs or pins can be used by workers for climbing using typical climbing/harness equipment gear, or as points of attachment to connect winches, pulleys, ratchet, or other type of lifting systems used for lifting equipment. Preferably, pegs/pins are placed on every segment of the threaded telescopic utility pole. One option is to simply have holes in the threaded surfaces of the segments in which to insert the pegs/pins, but any alternative means known in the art to attach pegs/pins to the segments are contemplated by this disclosure. It is preferred that anti-twist locking pins be used. However, alternatives such as pole steps can also be used. The step/anti twist locking mechanism can either screw into the drive holes or may go through to the other side where a keeper would stop it from sliding back out. The through pegs would lock so as not to twist when being stepped on. It is preferred that segment, the outermost segment which houses the other segments when in a retracted position, will accommodate multiple attachments to help secure pole to surfaces to prevent sliding, tipping or swaying. Other potential attachment means may include rings that rest upon the collets that connect with wires or other attachments. Any type of attachments known to a PHOSITA are contemplated by this disclosure. Alternatively, guy wire attachments can be placed on multiple segments. The use of guy wire and a pulley system can help support the threaded telescopic utility pole while in the erected or partially erected configuration.

Preferably the segments and lifting systems are comprised of dielectric materials such as fiberglass, but any dielectric material known to a PHOSITA to have the strength to withstand the longitudinal strains placed on pole as well as the down pressures of weight such as load and tension is contemplated by this disclosure. It is preferable that the pole be as lightweight as possible so as to be easily portable. The rod could consist of drill steel, carbon steel. The rod may need additional rod attachments to achieve desired depth.

Preferably the process of erecting the threaded telescopic utility pole to its erected configuration is manual and requires no machinery. The advantage of this is that the threaded telescopic utility pole is self-sufficient using no hydraulics, electricity, motors, wires, cables, straps or ratchets to erect the threaded telescopic utility pole to its extended position. In a non-limiting example of having segments with a threading pattern where one revolution equals 4 inches, it would take 24 turns to fully erect an individual segment. Two workers using a properly sized erecting tool as leverage can twist the individual segments to erect (or retract) the threaded telescopic utility pole. The size of tool needed will depend on the ultimate diameter of an individual segment. A non-limiting example of an erecting tool can be a step anti-twist locking style tool. Other non-limiting examples styles of tools that can be used are tools that are similar to spanner shock wrenches, rubber strap wrenches, or adjustable oil filter wrenches. Any tool that can use leverage to twist the segments by workers is contemplated by this disclosure. Erecting tools that use batteries are preferred, but manual operation is also an option.

Alternatively, any feasible motorized, hydraulic, or pneumatic methods known to those skilled in the art for retraction or erection is contemplated by this disclosure. Though shown being used with a stabilizer and a chassis in the Figures, alternatively, the threaded telescopic utility pole can be deployed for use by burying in the ground, for example, replacing a traditional utility pole.

The advantage of using the threaded telescopic utility pole is that it can be deployed and erected quickly as compared to traditional utility poles. No drilling or outside machinery (which may be very limited in a disaster area) is required to erect the threaded telescopic utility pole. In disaster areas, getting power and other utilities up and running as soon as possible are critical to start recovery. As temporary poles, they can be installed in pathways that are the shortest distance, say for example, from a power station to a hospital no matter the terrain along the path. This allows for more efficiency in providing critical utilities to those in need. The threaded telescopic utility pole can also be used in for example, in flooded areas or on rocky terrain where traditional pole setting is not possible.

In any of the embodiments of the disclosed invention, access holes can made in the various segments for purposes of running wires for equipment, connections for winches, attaching equipment, attaching pins or pegs, or any of several functions where an access hole would be useful. In any of the embodiments of the disclosed invention, dust covers may be used to in between segments to cover gaps and prevent dirt, leaves, water, etc. from accumulating on the inner surface areas of the segments.

The foregoing description merely illustrates the invention is not intended to be limiting. It will be apparent to those skilled in the art that various modifications can be made without departing from the inventive concept. Accordingly, it is not intended that the invention be limited except by the appended claims.

The invention claimed is:

1. A pole comprised of an outer bottom segment, an inner top segment, and a plurality of middle segments, the outer bottom segment being located at the bottom of the pole when elongated and having a threaded outer surface and a threaded inner surface and being largest in diameter, the inner segment being located at the top end of the pole when elongated and having a threaded outer surface, a threaded inner surface, and being smallest in diameter, the plurality of middle segments progressively having a smaller diameter with a bottom most middle segment having a largest diameter and a top most middle segment having a smallest diameter, and each middle segment having a threaded outer surface and a threaded inner surface;

wherein each of the plurality of middle segments are threadedly engaged with one another in a series from the largest diameter to the smallest diameter, wherein the middle segment with the largest diameter is threadedly engaged with the outer bottom segment, wherein the middle segment with the smallest diameter is threadedly engaged with the inner top segment, whereby the pole is capable of being erected manually using one or more nonmotorized erecting tools as leverage; the nonmotorized erecting tools being capable of twisting respective segments along their threaded surfaces until all segments are fully elongated from their adjacent segment; and whereby the outer bottom segment, the plurality of middle segments and the inner top segment form a conduit from the outer bottom segment to the inner top segment when elongated or retracted; said conduit capable of receiving an nonintegral non-telescopic fully threaded rod and wherein the pole is stabilized by said nonintegral non-telescopic fully threaded rod being releasably inserted into the inner top segment and continuing through the pole into a nonintegral base plate capable of receiving said nonintegral non-telescopic fully threaded rod.

2. The pole of claim 1, wherein the pole is threadedly attached to an all-terrain stabilizer.

3. The pole of claim 1, wherein the pole is threadedly attached to a chassis.

4. The pole of claim 1, wherein the outer bottom segment, the inner top segment, and each of the plurality of middle segments have a collet.

5. The pole of claim 1, wherein the threaded outer surface of the inner top segment and of the outer bottom segment is only partially threaded and wherein each of the threaded outer surfaces of each middle segment is only partially threaded.

6. The pole of claim 1 wherein each outer surface and each inner surface of their respective segments has square threading pattern.

7. The pole of claim 1 wherein one or more of the respective segments is capable of receiving pegs, the pegs capable of receiving fasteners for providing support to the pole when partially or fully elongated.

8. The pole of claim 1 wherein one or more of the respective segments is capable of receiving pins, the pins capable of receiving fasteners for providing support to the pole when partially or fully elongated.

9. The pole of claim 1 wherein one or more of the respective segments is further comprised of pole climbing steps.

10. The pole of claim 1 wherein one or more of the respective segments is capable of receiving at least one hardware attachment.

11. The pole of claim 1 wherein one or more of the respective segments is further comprised of half-moon bubble stop rivets.

12. The pole of claim 1 wherein the threaded inner surface of the outer bottom segment is fully threaded, the threaded inner surface of the inner top segment is fully threaded, and the threaded inner surface of each of the middle segments is fully threaded.

13. The pole of claim 1 whereby the pole is retracted by twisting the respective segments along their threaded surfaces.

14. The pole of claim 1, wherein one or more of the respective segments are further comprised of access holes.

15. The pole of claim 1 further comprised of dust covers.

16. The pole of claim 1 being comprised of dielectric material.

17. The pole of claim 1 wherein one or more of the respective segments capable of receiving anti-twist locking mechanisms.

18. The pole of claim 1, wherein the pole is buried into the ground.

19. The pole of claim 1, wherein the pole is capable of receiving guy wire attachments that are used for supporting the pole when partially or fully elongated.

* * * * *